United States Patent [19]

Emberson et al.

[11] Patent Number: 4,754,192

[45] Date of Patent: Jun. 28, 1988

[54] TERMINATION ARRANGEMENT FOR A CATHODE RAY DISPLAY TUBE

[75] Inventors: David L. Emberson; Adrian Caple, both of Purley, England

[73] Assignee: U.S. Philips Corporation, New York, N.Y.

[21] Appl. No.: 904,320

[22] Filed: Sep. 8, 1986

[30] Foreign Application Priority Data

Sep. 11, 1985 [GB] United Kingdom ..... 8522540

[51] Int. Cl.[4] ..... H01J 31/00

[52] U.S. Cl. ..... 313/477 R; 313/477 HC; 313/479; 313/482; 313/103 CM; 313/105 CM

[58] Field of Search ..... 313/477 R, 477 HC, 422, 313/482, 479, 402, 106, 107, 103, 103 CM, 105, 105 CM

[56] References Cited

U.S. PATENT DOCUMENTS

| | | | |
|---|---|---|---|
| 3,099,762 | 7/1963 | Hertz | 313/477 R |
| 3,205,391 | 9/1965 | Glyptis | 313/422 |
| 4,188,564 | 2/1980 | Zegers et al. | 313/477 HC |
| 4,232,248 | 11/1980 | McCue | 313/479 |
| 4,450,379 | 5/1984 | Kikuchi et al. | 313/477 HC |
| 4,528,477 | 7/1985 | Gallaro | 313/477 R |

FOREIGN PATENT DOCUMENTS

| | | | |
|---|---|---|---|
| 0168325 | 12/1981 | Japan | 313/422 |
| 2101396 | 1/1983 | United Kingdom | 313/422 |

*Primary Examiner*—David K. Moore
*Assistant Examiner*—Michael J. Nickerson
*Attorney, Agent, or Firm*—John C. Fox

[57] ABSTRACT

In a cathode ray display tube having a glass faceplate carrying a screen thereon including a screen electrode and an electron multiplier disposed adjacent the screen for current-multiplying an electron beam directed onto the screen, a low profile termination arrangement for establishing electrical connection with the screen electrode and a multiplier electrode comprises respective, spaced, thick film conductive tracks on the inner surface of the faceplate and bordering the screen connected at lead-in portions thereof with conductor means, e.g. conductive epoxy, in apertures extending through the faceplate via metal sealing discs.

11 Claims, 2 Drawing Sheets

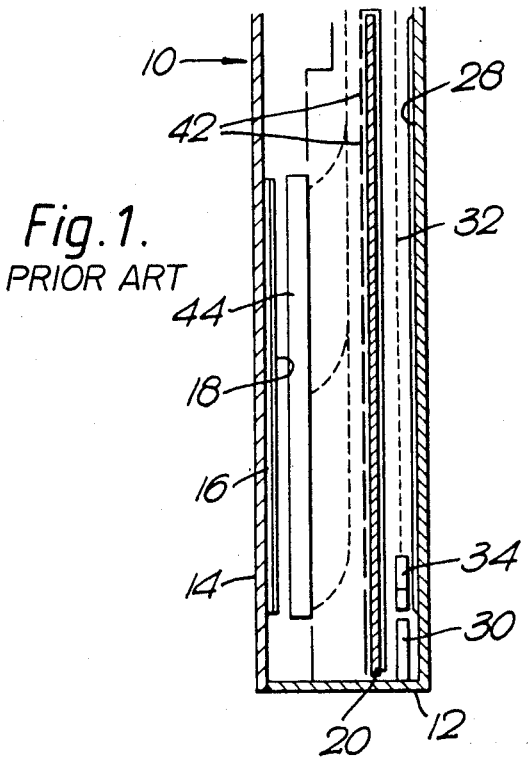
Fig. 1.
PRIOR ART
Fig. 3.
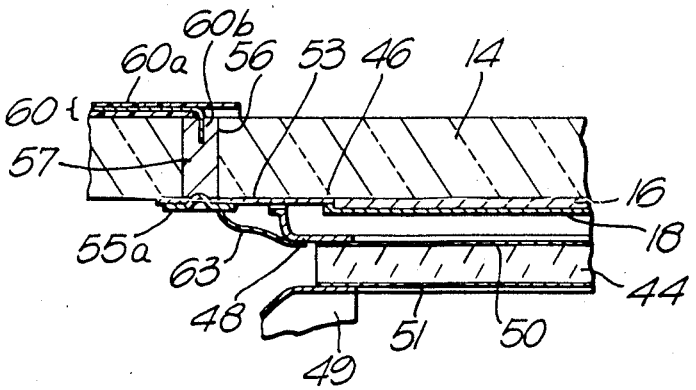

TERMINATION ARRANGEMENT FOR A CATHODE RAY DISPLAY TUBE

BACKGROUND OF THE INVENTION

This invention relates to a cathode ray display tube having an envelope with a glass faceplate, a screen carried on the inner surface of the faceplate comprising phosphor material and a screen electrode, an electron multiplier disposed adjacent the screen with its output facing the screen, and termination means for establishing electrical connection with the screen electrode and an electron multiplier electrode from outside the envelope.

The invention is concerned especially, but not exclusively, with a so-called "flat" cathode ray display tube generally of the kind described in published British Patent Application No. 2101396A corresponding to U.S. patent application Ser. No. 830,388, filed Feb. 14, 1986. With this kind of display tube a low energy electron beam is directed along a path parallel to screen and is turned through 180° so that it travels in the opposite direction. The beam is subsequently deflected onto the input surface of the electron multiplier where it undergoes electron multiplication, the current multiplied beam then being accelerated by the field established between the multiplier and the screen electrode onto the screen to excite the phosphor material. In one realised version of this display tube, although not specifically described in the aforementioned specification, the electron multiplier comprises a glass microchannel plate multiplier having electrodes on its input and output surfaces. Electrical interconnection from outside the envelope with the screen electrode, which comprises an aluminium layer deposited over the phosphor material, and the output surface electrode of the electron multiplier has been achieved by means of insulated wires extending through lead-in sleeves sealed in the envelope wall adjacent the faceplate which are connected to contact areas of the electrodes.

Whilst such connections were found to perform satisfactorily electrically, difficulty was experienced in ensuring adequate vacuum-tight seals between the wires and the envelope wall. More importantly however, the connections occupy a relatively large volume. Since a major object of a flat display tube is to minimise volume, the amount of space available within the envelope is at a premium and with internal components being located close together, the connections can interfere with other components, especially during assembly of the display tube. Any reduction in the volume occupied by internal components is considered therefore beneficial.

It is an object of the present invention therefore to provide a form of terminal arrangement providing interconnection between the screen and multiplier electrodes and outside the envelope which occupies little volume whilst at the same time maintaining reliable performance.

SUMMARY OF THE INVENTION

According to the present invention, there is provided a cathode ray display tube having an envelope with a glass faceplate, a screen carried on the inner surface of the faceplate comprising phosphor material and a screen electrode, an electron multiplier disposed adjacent the screen with its output facing the screen, and termination means for establishing electrical connection with the screen electrode and an electron multiplier electrode from outside the envelope, which is characterised in that the termination means for the screen electrode and electron multiplier electrode comprise respective conductive tracks carried on the inner surface of the faceplate which are connected at their one ends to the screen electrode and the electron multiplier electrode and at their other ends to respective conductor means extending through an aperture in the faceplate.

Such a termination arrangement has a very low profile and occupies minimal space within the envelope. Thus, accomodation of other internal components of the tube is not unduly impeded and assembly of those components within the envelope eased, there being more room for the other components and less risk of interference by, and damage caused to, the termination arrangement during assembly of the tube.

The conductive tracks may conveniently comprise thick film conductors, which may readily be applied directly on the surface of the faceplate by silk screening in the desired pattern.

The conductive track associated with the electron multiplier electrode may be connected to the multiplier electrode via a conductive spacing element between the multiplier and the faceplate which contacts electrically the multiplier electrode. This spacing element may be in the form of a metal frame extending between the multiplier and faceplate and around the periphery of the multiplier, the associated conductive track extending on the surface of the faceplate intermediate the frame and the faceplate with the frame in contacting engagement with the track. In this way, the spacing element ensures correct spacing of the multiplier from the screen, thus maintaining the multiplier output surface in parallel relationship with the screen, and reliable interconnection between the conductive track and frame over a large area is achieved.

The other conductive track, associated with the screen electrode, may contact the screen electrode directly, the screen electrode being deposited so as to extend onto the conductive track and contacting therewith. This conductive track preferably surrounds the screen and the screen electrode contacts with the track substantially completely therearound, thus giving reliable interconnection.

Particularly in the case where both conductive tracks surround the screen, a layer of resistive material, for example chromium oxide, may be deposited on the surface region of the faceplate between the two conductive tracks and electrically contacting the tracks. Such a layer serves the useful purpose of preventing charge build-up on the faceplate during operation.

Each conductor means extending through an aperture in the faceplate preferably comprises conducting epoxy material. Such material provides a simple, yet reliable, conductive path through the aperture in the faceplate. The entrance to each aperture inwardly of the faceplate may be sealed by a metal member for example in the form of a disc with a central dome overlying the entrance to the aperture which contacts the associated conductive track and is sealingly bonded to the faceplate around the aperture. As a result, adequate and dependable vacuum-tight sealing of the apertures is obtained.

In order to ensure reliable, low-impedance interconnection between the multiplier electrode and its associated conductor means, a conducting element, for example a length of thin metal tape, is preferably connected directly between the spacing element and the aperture-sealing metal member associated therewith, the conducting element supplementing the connection provided by the conductive track associated with the multiplier electrode.

On the outside of the envelope, insulated conductors may be connected to the conductor means extending through the apertures in the faceplate. Preferably the insulated conductors comprise substantially flat tape conductors covered with insulative material, the end of the conductor being exposed and encapsulated in the conductive epoxy material within the aperture. Such tape conductors can be laid over the outer surface of the faceplate and, being flat, occupy little height and are able to conform with the outer surface of the faceplate without affecting adversely the generally flat nature of the faceplate. By connecting the remote ends of these insulated conductors to a suitable source, electrical potentials are applied via the termination arrangement to the screen electrode and electron multiplier within the tube's envelope.

BRIEF DESCRIPTION OF THE DRAWINGS

A cathode ray display tube according to the present invention will now be described, by way of example, with reference to the accompanying drawings in which;

FIG. 1 is a diagrammatic cross-sectional view through a flat cathode ray display tube showing, schematically, the major components thereof;

FIG. 3 is a schematic cross-sectional view of part of the display tube taken along the line III—III of FIG. 2 showing a termination arrangement for certain components of the tube in accordance with the invention.

DESCRIPTION OF THE PREFERRED EMBODIMENT

Figure 2:
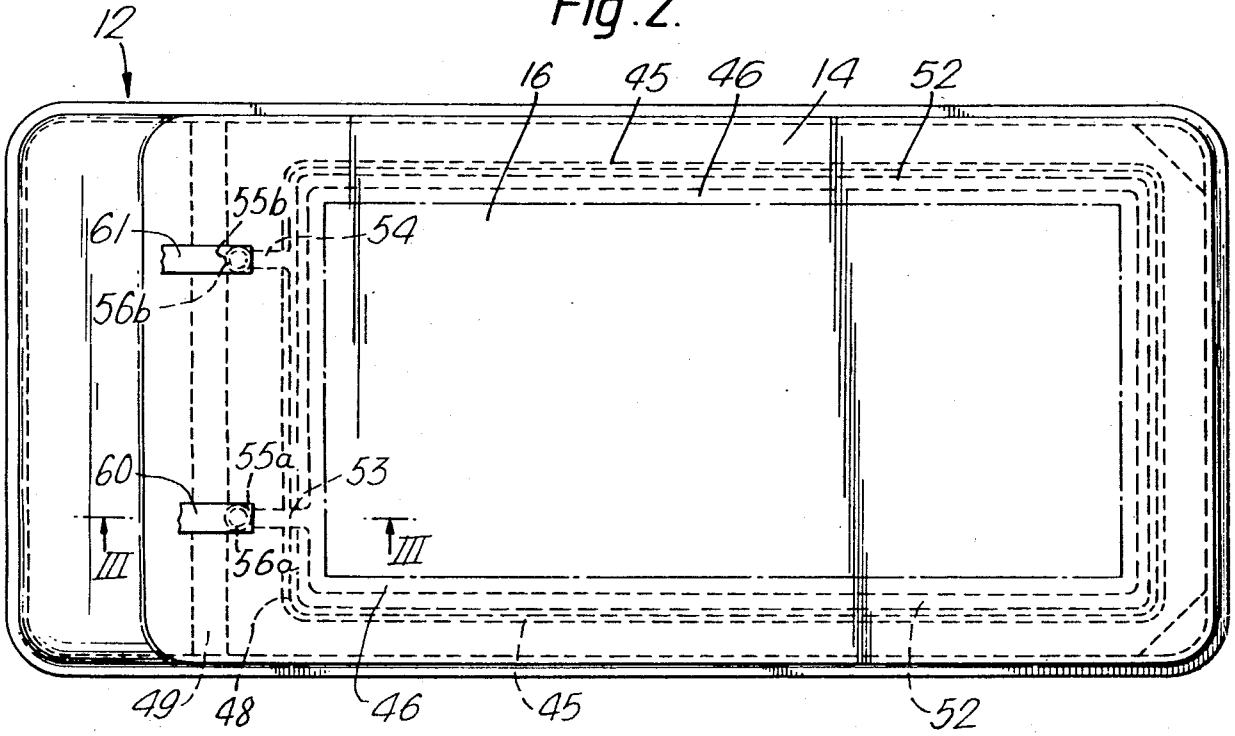
FIG. 2 is a plan view of the display tube of FIG. 1.

Referring to FIG. 1, the display tube 10 comprises a flat-walled, rectangular envelope 12 including a flat, optically transparent, faceplate 14, the remaining walls being formed as pressings of a metal alloy or mild steel. Carried on the inside of the faceplate, there is a screen comprising a layer of phosphor material 16 completely covered by an aluminium screen electrode 18. An electron gun 30 generates a low-energy electron beam 32 which is directed parallel to the rear wall 28 of the envelope, and the faceplate 14, towards a reversing lens 36 at the upper end of the envelope which acts to turn the electron beam through 180° around a central partitioning plate 20 so that it travels in an opposite direction along a path also parallel to the faceplate 14. Line scanning is achieved by means of deflecting electrodes 34 located adjacent the electron gun 30. Frame deflection is accomplished by means of a plurality of electrodes 42 carried on the partitioning plate 20 which, by the application of appropriate potentials to selected ones thereof cause the beam to be deflected towards the input surface of an electron multiplier 44 extending parallel to, and adjacent, the phosphor screen 16. Having undergone electron multiplication within the multiplier 44, the beam is accelerated from the output surface thereof onto the phosphor screen 16, by a field established between the screen electrode 18 and the multiplier, the potential difference across this field being around 15 kv.

The display tube is generally similar to that described in published British Patent Application No. 2101396A corresponding to U.S. patent application Ser. No. 830,388, filed Feb. 14, 1986 (PHB32794) whose disclosure is incorporated herein by reference. For a fuller description of the construction and operation of the tube, reference is invited to the aforementioned Application.

In this particular embodiment, the electron multiplier comprises a glass micro-channel plate multiplier having a matrix of millions of channels of, say, 12 μm diameter and 15 μm pitch and with electrodes covering its input and output surfaces. The fabrication of glass matrix electron multipliers is generally well known and accordingly will not be described here in detail. For further information in this respect however reference can be made to, as an example, Acta Electronica Volume 14, No. 2, April 1971.

FIG. 2 is a plan view of the display tube showing in particular the front glass faceplate 14, extending over a region of the internal surface of which is the phosphor screen 16. In the embodiment of FIG. 2, the screen 16 is shown as being rectangular but it will be appreciated that alternative screen shapes may be used instead. The glass faceplate 14 is sealed around its periphery to the side wall parts of the envelope in a vacuum-tight manner using, for example, glass frit.

Referring now also to FIG. 3 which shows in detail the termination arrangement for the screen electrode 18, the phosphor screen is bordered by a screen-printed thick film conductive track 46 directly deposited on the inner surface of the faceplate 14. The track is formed initially of a conductive ink comprising silver particles in glass powder with a thick film vehicle which is subsequently backed away. A thin layer of aluminium constituting the screen electrode 18 is evaporated over the surface of the phosphor material and its edge so as to overlie partially the track 46 completely therearound.

Referring now to FIG. 2, a further screen-printed thick film conductive track 45 of similar material deposited directly on the faceplate 14 extends completely around the track 46, except for a small section where a portion of the track 46 passes outside the confines of track 45, and is spaced a predetermined distance from the track 46. The surface region of the faceplate 14 intermediate the tracks 45 and 46 is coated with a layer 52 of chromium oxide after deposition of the tracks 45 and 46 which completely covers the region and electrically contacts both tracks 45 and 46. The chromium oxide material is leaky resistive and the layer 52 has a high surface resistivity and presents a uniform potential gradient between the two tracks to prevent charge build up on the glass faceplate 14 during operation of the tube.

Referring now to FIGS. 2 and 3, the electron multiplier 44 is supported parallel to, and spaced from, the screen 16 by means of a stamped metal spacing frame 48 whose faceplate facing edge corresponds in shape with, and overlies, the track 45 and which extends completely around the peripheral edge of the output side of the multiplier and engages therewith. The multiplier 44 is urged against the frame 48, and in turn, the frame 48 is clamped against the track 45 on the faceplate 14, by means of a further structural member within the envelope shown in part at 49 in FIG. 3. Planar surfaces of the frame 48 and structural member 49 contact electrically with output and input surface electrodes 50 and 51 respectively of the multiplier 44 allowing electrical potential to be applied to the electrodes through these components. For simplicity, the track 46 and spacing frame 48 have been omitted from FIG. 1.

A pair of spaced lead-in portions 53 and 54 of the tracks 46 and 45 respectively (only one of which is visible in FIG. 3) are formed simultaneously with the tracks 45 and 46 and extend on the inner surface of the faceplate 14 away from the screen 16. The spacing frame 48 is deformed at the region where it crosses over the track portion 53 so that it bridges the track 53 without physical contact.

The ends of each of the track lead-in portions 53 and 54 remote from the screen surround a respective aperture 56*a* and 56*b* extending through the faceplate. Metal discs 55 having a central dome are laid over the exposed surface of each of the conductive ink track portions prior to baking of the ink with its dome passing through the track portion into the aperture 56. The track-engaging surface of the discs 55 are coated with conductive frit material and upon firing of the tracks, causing the glass powder of the conductive ink to melt, the discs 55 are bonded to the faceplate 14 and seal the inner ends of the apertures 56 in a reliable vacuum-tight manner. The apretures 56 are subsequently filled with conductive epoxy 57 so as to enable electrical connection to be achieved through the faceplate 14 with the discs 55, and thus the track portions 53 and 54.

Electrical connection with the conductive epoxy 57 in each aperture 56 is achieved by insulated tape conductors 60, 61 each comprising a flat ribbon-like conductor 60*b* and 61*b* (not shown) covered in insulative material 60*a* and 61*a* (not shown) and bonded to the outer surface of the faceplater 14, a part of the insulation on one side of the tape conductor adjacent its end being removed and the exposed conductor bent into its associated aperture and encapsulated in the conductive epoxy. The tape conductors lie substantially flat on the outer surface of the faceplate 14.

By connecting the remote ends of the tape conductors to a suitable source, appropriate potentials (around 15 kv and 1 kv) are applied via the conductive epoxy 57 in the apertures 56, the discs 55, conductive tracks 46 and 45 respectively to the screen electrode 18 and, via frame 48, multiplier electrode 50. In operation of the tube, with the input surface electrode 51 of the multiplier 44 at a predetermined potential with respect to the output electrode 50 applied via the part 49, the low-energy electron beam deflected into the channels of the multiplier 44 of the electrodes 42 undergoes current multiplication and thereafter is accelerated onto the screen 16 by means of the screen electrode 18 to produce a display.

As shown in FIG. 3, a small length of thin metal tape conductor 63 may be connected directly between the disc 55*b* associated with the conductive track portion 54 (both hidden by disc 55*a* and conductive track portion 53) and the frame 48, to supplement the conductive path provided by the track 45.

The part of the termination arrangement within the envelope 12 is of low profile and intrudes only minimally into the envelope volume. Thus the risk of the termination arrangement interferring with internal components of the tube or vice versa during assembly is substantially avoided, and, compared with the earlier arrangement, more space is made available in the region of the termination arrangement for accomodating other components.

We claim:

1. A cathode ray display tube having an envelope with a glass faceplate, a screen carried on the inner surface of the faceplate comprising phosphor material and a screen electrode, an electron multiplier disposed adjacent the screen with its output facing the screen, and termination means for establishing electrical connection with the screen electrode and an electron multiplier electrode from outside the envelope, characterised in that the termination means for the screen electrode and electron multiplier electrode comprise respective conductive tracks carried on the inner surface of the faceplate which are connected at their one ends to the screen electrode and the electron multiplier electrode and at their other ends to respective conductor means extending through an aperture in the faceplate.

2. A cathode ray display tube according to claim 1, characterised in that the conductive tracks comprise thick film conductors.

3. A cathode ray display tube according to claim 1, characterised in that the conductive track associated with the electron multiplier is connected to the multiplier electrode via a conductive spacing element between the multiplier and the faceplate which contacts electrically the multiplier electrode.

4. A cathode ray display tube according to claim 3, characterised in that the spacing element is in the form of a metal frame extending between the multiplier and faceplate and around the periphery of the multiplier and in that the associated conductive track extends on the surface of the faceplate intermediate the frame and the faceplate with the frame in contacting engagement with the track.

5. A cathode ray display tube according to claim 1, characterised in that the conductive track associated with the screen electrode contacts the screen electrode directly with the screen electrode extending onto the conductive track and contacting therewith.

6. A cathode ray display tube according to claim 5, characterised in that the conductive track associated with the screen electrode is arranged to surround the screen and in that the screen electrode contacts with the track substantially completely therearound.

7. A cathode ray display tube according to claim 6, characterised in that a layer of resistive material is deposited on the surface region of the faceplate between the two conductive tracks and electrically contacts the two conductive tracks.

8. A cathode ray display tube according to claim 3, characterised in that each conductor means extending through an aperture in the faceplate comprises conductive epoxy material.

9. A cathode ray display tube according to claim 8, characterised in that the termination means further includes an insulated flat tape conductor extending over the outer surface of the faceplate, the end of the conductor being exposed and encapsulated in the conductive epoxy material within the aperture.

10. A cathode ray display tube according to claim 8, characterised in that the entrance to each aperture inwardly of the faceplate is sealed by an aperture sealing metal member overlying the entrance which contacts the associated conductive track and is sealingly bonded to the faceplate around the aperture.

11. A cathode ray display tube according to claim 10, characterized in that a conducting element is connected directly between the spacing element and the aperture-sealing metal member associated therewith.

* * * * *